United States Patent [19]

Boyer

[11] 4,080,177

[45] *Mar. 21, 1978

[54] COLLOIDAL MAGNESIUM SUSPENSION IN CRITICAL LOW CONCENTRATION IN JET FUEL

[76] Inventor: Winston Boyer, The Boyer Ranch, Savey, Wyo. 82332

[ * ] Notice: The portion of the term of this patent subsequent to Mar. 21, 1995, has been disclaimed.

[21] Appl. No.: 568,998

[22] Filed: Apr. 17, 1975

[51] Int. Cl.[2] ..... C10L 1/32

[52] U.S. Cl. ..... 44/51; 44/67; 252/309

[58] Field of Search ..... 44/51; 252/309; 149/87

[56] References Cited

U.S. PATENT DOCUMENTS

| | | | |
|---|---|---|---|
| 2,671,758 | 3/1954 | Vinograd et al. | 252/309 |
| 3,069,854 | 12/1962 | Toulmin, Jr. | 149/87 |

*Primary Examiner*—Daniel E. Wyman
*Assistant Examiner*—Mrs. Y. Harris-Smith

[57] ABSTRACT

A colloidal magnesium suspension is prepared by grinding 400 mesh pure magnesium (99.8+%) in dry kerosene until it reaches colloidal dimensions (from about 500 to 1 millimicron) and is thereafter added in critical low concentration of at least 1 gram as substantially pure magnesium up to about 15 grams per 10 gallons of jet fuel whereby improved burning of the jet fuel is observed as evidenced by improvement in mileage of about 10 to 30% for the same jet engine setting as compared to the jet fuel to which the colloidal magnesium has not been added. Optimum amounts of about 3 to 8 grams of colloidal magnesium in 10 gallons are preferred in order to minimize air pollution while giving maximum benefit for jet fuel economy.

1 Claim, No Drawings

COLLOIDAL MAGNESIUM SUSPENSION IN CRITICAL LOW CONCENTRATION IN JET FUEL

CROSS REFERENCE TO RELATED APPLICATIONS

Application of Winston Boyer entitled, "Colloidal Magnesium Suspension in Critical Low Concentration in Motor Gasoline and Method of Preparation", filed on even date herewith, Ser. No. 569,320, filed Apr. 17, 1975.

Application of Winston Boyer entitled, "Colloidal Magnesium Suspension in Critical Low Concentration in Diesel Fuel", filed on even date herewith, Ser. No. 568,999, filed Apr. 17, 1975.

BACKGROUND OF THE INVENTION

A. Field of the Invention

The invention lies in the field of suspension of non-gaseous solid materials, these materials being in colloidal size and obtained by grinding very finely divided substantially pure magnesium metal in dry substantially easily burning low volatility petroleum, and in particular kerosene and also is in the field of suspensions of this colloidal dispersion of substantially pure magnesium (500 to 1 millimicrons) in jet fuel in critical proportions for the purpose of aiding combustion, there being no non-oxyhydrocarbons or non-hydrocarbon additives required for the addition and suspension and thereby controlling emissions, while improving fuel economy and efficiency.

B. Description of the Prior Art

1. Motor Fuel Economy and Emission Controls

The problem of fuel economy and emission controls has come to the forefront since the Arab Oil Embargo in 1973–74 and has gripped the attention of the public, the supplier of the add-on catalytic converter and the domestic oil industry in the United States.

Interim efforts at emissions control due to automobiles are being directed to add-on pollution control devices, such as the platinum catalyst charged converter which cuts emissions to meet standards in the states and of the Federal Government. The results these past 10 years have been encouraging as stated by Gladwin Hill in the New York Times, Business Section, page A15, who reports as follows:

In 1966, when cars began using exhaust controls, the Los Angeles County Air Pollution Control District reported that the area's 3,770,000 cars were spewing out 10,485 tons of carbon monoxide each day, 1,805 tons of hydrocarbons (unburned gasoline) and 545 tons of oxides of nitrogen.

Today, with 4,470,000 cars in the area, the total is down to 5,040 tons of carbon monoxide, a 50 per cent decrease, 625 tons of hydrocarbons, a two-thirds decline, and 530 tons of oxides of nitrogen. Nitrogen oxide controls are relatively new and difficult to remove.

In 1966, there were 271 days of excessive oxidants (compounds formed from car fumes by sunlight, and often irritating to the eye); 89 days of excessive nitrogen oxides, which accounts for the brownish tint to smog, and 365 days of excessive carbon monoxide.

In 1973, there were 185 days of excessive oxidants, 59 days of excessive nitrogen oxide, and 116 days of excessive carbon monoxide.

For the first 10 months of 1974, the totals were 202 days of excessive oxidants, 44 days of excessive nitrogen oxides and 71 days of excessive carbon monoxide.

A significant part of the problem in pollution is the problem of air craft using jet fuels and the risks are comparable to those of the auto emissions except on a smaller scale.

2. Prior Art Patents a. Methods of Preparing Colloidal Metal Suspensions

Various methods are known for making colloidal metals, for example, Vaughn, U.S. Pat. No. 2,123,617, describes a method of making colloidal metal by reaction in liquid ammonia, and the literature makes references to electrolytic processes for the manufacture of colloidal magnesium.

These prior methods are expensive to carry out, because of the high cost for equipment and the need for highly skilled personnel, not to mention the high energy requirement for electrolytic processing. A further important disadvantage is the formation of impurities, oxides or nitrides, which occurs because of the high reactivity of magnesium.

In contrast to the above methods for preparing colloidal magnesium, the present process carries out the grinding by starting from 400 mesh pure (99.8+%) magnesium powder, which is dispersed in dry kerosene. The dispersing liquid is substantially free from water, and thus eliminates one of the most important reactions of metallic magnesium, which is that with water. Under ordinary atmospheric conditions or in pure water or saltfree water of high pH, however, the reaction is self-stopping, because of the formation of an insoluble hydroxide film:

$$Mg + 2\,H_2O \rightarrow Mg(OH)_2 + H_2$$

b. Finely Divided Magnesium in Fuels

The patent to Toulmin, Jr., U.S. Pat. No. 3,122,429, discloses a slurry of magnesium finely divided coal and ozone in jet fuel in weight ratio of 25/75 solid fuel to liquid fuel.

The patent to Toulmin, Jr., U.S. Pat. No. 3,147,091, discloses a composite fuel of 35% by weight of powdered coal and magnesium and remainder liquid hydrocarbon.

The patent to Nixon et al, U.S. Pat. No. 3,709,747, discloses 50 to 70% by weight of finely divided metal in JP-4 Jet fuel with emulsifier and formamide.

The patent to Nixon et al, U.S. Pat. No. 3,732,084, discloses 60% by weight of finely divided coal and emulsifier in JP-4 Jet fuel and formamide.

A common concept in the pumpable fuel formulations of the Nixon et al and Toulmin, Jr. patents is the requirement for one or more emulsifier additives or polar organic liquid additives such as metal soap catalysts in Toulmin Jr. or formamide-urea as dispersing agent to serve to coat the particles of finely divided solids, such as metals or coal dust.

A further common concept in the Nixon et al and Toulmin, Jr. patents is the calorific requirement of the powdered solid, such as metal in order to increase the thrust of the jet fuel. For example, the preferred quantity of finely divided carbon in Nixon et al is from 20 to 68 weight percent of the liquid fuel and obvious this substantial amount provides a major calorific contribution to thrust. In Toulmin, Jr. special mention is made of the need for combustible coal and metal to produce high fuel temperature and maximum B.T.U. values under conditions where ignition temperatures range from 200° up to 1,000° C and more (see U.S. Pat. No. 3,122,429, column 6, lines 70 to 72 and lines 30 to 32).

In contradistinction to these prior art patents, the present fuel uses substantially no calorific amount of powdered metal and is restricted to low ignition temperatures relying on critical proportions and autocatalytic action, which uniquely coacts in improving combustion without overheating.

OBJECTS OF THE INVENTION

An object of the invention is to provide a noncarbonaceous pure magnesium metal additive in critical low concentration and in colloidal form in jet fuel of between about 1 to 15 grams per 10 gallons of fuel whereby substantially no increase in calorific value or B.T.U. value is observed.

A further object of the invention is to provide colloidal pure magnesium fuel from emulsifiers or polar nonoxy-hydrocarbon additives which serve to pollute the atmosphere after burning.

A further object of the invention is to modify the burning of jet fuel which is characterized by a boiling range of 150° to 600° F under ASTM Specification D-975-53T and are designated as JP-4 JP-5, and JP-6 under U.S. Military Specification MIL-T-5624-G or as aviation turbine fuel over ASTM Specification MIL-T-5624-G which boils in a range of 200° to 500° F by introducing critical amounts of pure colloidal magnesium metal, in concentrations of about 1 to 15 grams per 10 gallons to improve burning efficiency, mileage, and reduce pollution as compared with the same jet fuel to which the magnesium has not been added.

Other objects will be apparent from the specific examples which follow.

SUMMARY OF THE INVENTION

Colloidal magnesium metal of high purity (99.8+%) prepared by grinding 400 mesh pure magnesium in dry kerosene is added in critical low concentrations of 1 to 15 grams, preferably about 3 to 8 grams in each 10 gallons of jet fuel and provides improved burning as evidenced by increased mileage and less pollution as compared with the same jet fuel to which the colloidal magnesium has not been added.

DESCRIPTION OF THE PREFERRED EMBODIMENTS

EXAMPLE 1

Preparation of Colloidal Pure Magnesium in Dry Kerosene by Grinding

Commercially pure 400 mesh magnesium metal (99.8+% and about 0.003% each of aluminum and copper, 0.03% iron, 0.08% Manganese, 0.001% mickel, and 0.005% silicon) supplied by Reed Manufacturing Company, Lakehurst, New Jersey, is dispersed in dry kerosene in a ratio of 25 parts by weight of megnesium (50 grams) to 75 parts by weight of dry kerosene, and the entire mixture is charged into the 17¾ inch diameter mixing bowl of a Vulcan Hart Heavy Dough Mixing Machine, which grind in the mixing bowl by rotary rubbing movement of a top moving circular steel plate of ½ inch thickness and 11¾ inch diameter against a base circular plate of ¼ inch by 17¼ inch diameter. To eliminate contamination by iron particles, the base plate was replaced by a 3% Al — 1% Zn — magnesium plate ¼ inch thick 17¼ inches in diameter. The rubbing movements of the top plate are controlled by eccentrics to define an ovoid movement in different portions of the larger base plate.

After 8 hours of grinding, the suspension was filtered and determined to be colloidal (microscope examination) between 1 and 500 millimicrons. The mixture was filtered through fine cloth and less than 1% was removed.

EXAMPLE 2

Mixing Colloidal Magnesium in Jet Fuel

In this example, there is illustrated the optimum proportions of colloidal magnesium for the burning of aviation turbine fuels, which are specified under the Aviation Turbine Fuel Specification ASTM D 1665 by the following properties in Table 1 below:

Table 1

Specification of Aviation Turbine Fuels (ASTM D 1665)

| Properties | TYPE Jet A | Jet A-1 | Jet B |
|---|---|---|---|
| gravity, ° API | 51–39 | 51–39 | 57–45 |
| distillation, ° F | | | |
| 10% evaporated, max | 400 | 400 | |
| 20% evaporated, max | | | 290 |
| 50% evaporated, max | 450 | 450 | 370 |
| 90% evaporated, max | | | 470 |
| final boiling pt, max | 550 | 550 | |
| vapor pressure, max, psi | | | 3 |
| flash pt, ° F | 110–150 | 110–150 | |

Table 2

| Properties | TYPE Jet A | Jet A-1 | Jet B |
|---|---|---|---|
| freezing pt, max, ° F | −36 | −54 | −56 |
| viscosity, kinematic, max, cS at −30° F | 15 | 15 | |
| net heat of combustion, min, Btu/lb | | 18,400 | |
| sulfur, max, wt% | | 0.3 | |
| water tolerance, max, ml | | 1 | |
| gum, existent, max, mg/100 ml | | 7 | |
| aromatics, max, vol% | | 20 | |

Under the above specification Jet A is a kerosene fuel of high flash point, but somewhat higher freezing point that Jet A-1 or Jet B. Jet B is wider boiling and contains a higher proportion of gasoline range fractions than either Jet A or Jet A-1.

It has been determined by comparison of gasoline fraction burning as mentioned in my copending application WB 1 entitled, "Colloidal Magnesium Suspension in Critical Low Concentration in Motor Gasoline and Method of Preparation" filed on the same date as the present application, that slightly larger amounts of colloidal magnesium are useful for Jet A and A-1 than for Jet B and that in the case of optimum burning and economy of jet fuels that larger proportions, e.g., 1 to 15 grams of colloidal magnesium per 10 gallons in these jet fuels rather than the 1/5 to 10 grams in motor gasoline.

The optimum concentration for Jet A and Jet A-1 is about 4 to 8 grams of colloidal magnesium per 10 gallons of Jet A type fuel.

The optimum for Jet B fuel is about 3 to 5 grams of colloidal magnesium per 10 gallons of Jet B type fuel.

These optimum amounts are determined as a result of significant improvement in burning in amounts which assure combustion under the conditions encountered in the engine, as for example, in the Lear Jet aircraft.

It has been determined that excessive amounts, above 10 grams of colloidal magnesium in 10 gallons of jet fuel contribute no added benefit and merely add to the cost.

Obviously, it is within the spirit of the invention to achieve optimum results at lowest cost, but the principle of the invention would not be changed if a few grams more beyond 15 grams were used despite the waste and increase cost.

The best mode of adding the colloidal substantially pure magnesium is to the Kerosene medium of Example 1.

If a suspending agent is desirable, it can be an oxygenated combustible hydrocarbon or combustible ester of a carboxylic acid such as is known under the trademark Alox or STP. Other oxygenated hydrocarbon combounds may be used such as alkylphenyl polyethylene glycol ethers such as Tergitol NPX of Carbide and Carbon Company; polyethylene polyoxpropylene glycol such as Pluronic L-64 of Wyandotte Chemical Company; rosin acid esters of polyoxyethylene glycol such as Ethofat 242/25 of Armour Industrial Chemical Company; and alkylphenyl polyethoxy alkanols, such as Triton X-102 which is iso-octyl phenyl polyethoxy ethanol, i.e., the reaction product to iso-octylphenol and ethylene oxide.

What is claimed is:

1. Composition consisting essentially of, aircraft jet fuel and pure colloidal magnesium to be used in a jet aircraft engine;

said colloidal magnesium being metal-soap-free in, a small volume of kerosene the particle size of said magnesium being from about 1 to about 500 millimicrons; and, said jet fuel in which the colloidal magnesium is suspended together with said kerosene providing said magnesium at a critical concentration of at least 1 up to 15 grams of magnesium per 10 gallons of jet fuel.

* * * * *